United States Patent [19]

Byrne

[11] Patent Number: 4,579,403

[45] Date of Patent: Apr. 1, 1986

[54] ELECTRICAL JUNCTION ASSEMBLY WITH ADJUSTABLE CONNECTORS

[76] Inventor: Norman R. Byrne, 2736 Honey Creek, NE., Ada, Mich. 49301

[21] Appl. No.: 579,021

[22] Filed: Feb. 10, 1984

[51] Int. Cl.[4] ..... H01R 41/00

[52] U.S. Cl. ..... 339/9 E; 339/119 C

[58] Field of Search ..... 339/9 R, 9 E, 119 C, 339/27 R, 6 RC, 8 RL, 9 RY, 122 R; 179/69, 99 R, DIG. 9, 103, 17 VA

[56] References Cited

U.S. PATENT DOCUMENTS 2,411,018 11/1946 Benander ..... 339/122 R X 4,211,464 7/1980 Lee ..... 339/122 R

*Primary Examiner*—Eugene F. Desmond

*Attorney, Agent, or Firm*—Varnum, Riddering, Schmidt & Howlett

[57] ABSTRACT

One embodiment of an electrical junction assembly (10) for providing expansion and retraction of an electrical outlet or connector (20) comprises a main housing (12) having a conduit box (16), with a flexible conduit (18) interconnecting the connector (20) and box (16). Incoming wires (23, 24) are received within an insulated connector receptacle (28) and thereat spliced to conductive wires (22) received within the conduit (18) and terminating at the connector (20). The conductive wires (22) are coiled within the main housing (12) so as to allow slack for purposes of expansion and retraction of the connector (20) and conduit (18). In another embodiment, electrical cable (54) is coiled around an elliptically configured center support (62) within an expansion box (50), and allows expansion through opposing conduit portions (52) with automatic retraction when external forces are removed from the conduit portions (52).

13 Claims, 8 Drawing Figures

ELECTRICAL JUNCTION ASSEMBLY WITH ADJUSTABLE CONNECTORS

DESCRIPTION

1. Technical Field

The invention relates to electrical connector assemblies, and, more particularly, to electrical assemblies having means for relative expansion and retraction of electrical connectors and conductors.

2. Background Art

In various types of environments comprising electrical equipment or wherein electrical apparatus are otherwise employed, interconnections of electrical components are typically formed by means of conductive cables or wires. For example, in modern office systems comprising modular funiture components, it is often necessary to provide electrical interconnections between incoming power supplies and various types of electrical devices typically used in an office environment, such as electric typewriters, lamps, etc. Computer-related devices, such as video display terminals and similar peripherals, are also now commonly employed in various office and industrial environments.

One advantage inherent in modular office systems is the capability to rearrange furniture components as necessitated by changes in space requirements, resulting from changes in the number of personnel and other business-related considerations. However, these modular systems must not only allow for change in furniture configurations, but must also provide for convenient interconnection between modular electrical devices regardless of the spatial configuration of the modular systems and resultant variable distances between electrical devices.

This problem, of course, could be overcome by the use of extension conductors having sufficient length to connect the electrical devices. However, the use of such conductors would be expensive and result in unslightly and sometimes dangerous arrays, with resultant entanglements of the conductors.

To avoid the use of such inefficient conductors, it is possible to interconnect a series of shorter length conductors as necessary to provide requisite electrical power. Such interconnection can also result, however, in a relatively less aestheticly pleasing environment. To enhance the aesthetics, "electrical junction" or energy "tap" boxes can be employed, each having electrical conductors of prescribed length extending from within. These boxes can also be used to insulate splice connections between conductors.

Unfortunately, however, a primary problem exists when electrical conductors and interconnection assemblies are designed so as to "tightly" connect these devices. Specifically, when manufacturing and "laying out" products such as modular office systems and associated electrical equipment, it is difficult to achieve the precision tolerances necessary to incorporate electrical conductors having an "exact" length. In addition, precision cutting and splicing of the actual electrical conductors is often difficult to achieve. This would be especially true if conductors were to be spliced together "on-site." In addition, with conductor temperature variations resulting from environmental characteristics and the conductors carrying varying magnitudes of electric current, expansion and contraction of the conductors must also be taken into account.

The problem of large scale expansion/contraction in transmission conductors utilized to transmit power over substantial distances was addressed in the U.S. Pat. No. 3,591,703 to Swenck et al, issued July 6, 1971. The Swenck et al patent describes an electrical expansion joint system employing spaced apart expansion joints coaxially connected to a conductor. Each joint comprises a pair of end plates secured to adjacent conductors, with a series of parallel flexible leads attached between the end plates around their periphery.

At the center portion of the leads, a disc is concentrically positioned relative to the end plates, and includes outer slots to mount the leads. A torsion spring is mounted to the disc and tends to rotate the disc in a direction so as to take up slack in the leads caused by movement of the end plates towards each other during expansion. In this manner, the torsion spring also prevents the leads from expanding radially outward during expansion of the conductors.

Problems associated with splicing arrangements are addressed in the U.S. Pat. No. 256,866 to Teal, issued Apr. 25, 1882. The early Teal patent describes an underground cable arrangement whereby a primary conduit pipe having an inner cable includes transverse pipe sections. Short lengths of cable are pulled into the transverse sections for subsequent splicing to external wires.

Problems associated with splicing are also discussed in an article from the "Transmission and Distribution" magazine entitled "How to Cut Costs on Those Uncompleted URD Jobs." The article is dated July, 1975 and describes a particular scheme for overcoming the problem of having to splice in transformer cable taps to primary cables after the primary cable has been laid. To overcome this problem, the primary cable is brought out of the ground at a site where it is contemplated that a transformer may later be installed. The cable is trained into a double loop and a sheet steel box opened at its lower end is set vertically over the cable loop. Although the aforedescribed patents and magazine article describe concepts associated with splicing and expansion of conductive electrical components, none are directed to problems associated with interconnection of conductive components adapted for use within environments such as modular office systems.

SUMMARY OF THE INVENTION

In accordance with the invention, an electrical junction assembly is adapted for use in interconnecting electrical apparatus with electrical power consumption or supply apparatus. The junction assembly is adapted to provide a means of electrical interconnection so that conductive connectors are allowed to expand or retract as required. The junction assembly comprises a main housing having an internal spatial area, along with at least one flexible conduit connected to a side portion of the main housing and extending outwardly therefrom.

Conductive wire means extend inwardly into the main housing at a first location, and further extend outwardly from the main housing at a second location. The conductive wire means are received within the at least one flexible conduit at the second location, and are located within the internal spatial area. The conductive wire means are also coiled or looped within the internal spacial area so as to provide for expansion and retraction of the wire means at the second location in correspondence to expansion and retraction of the length of the at least one flexible conduit. The conductive wire means can thus remain stationary at the first location during expansion or retraction of the conductive wire means at the second location.

The conductive wire means includes a first set of wires extending inwardly into the main housing at the first location, and a second set of wires extending outwardly from the main housing at the second location. The second set of wires are received within the flexible conduit at the second location, and the first and second sets of wires are spliced together within the internal spatial area.

The electrical junction assembly also includes insulated receptacle means mounted within the main housing for providing insulation between splices of the first and second sets of wires. The insulated receptacle means can include a rectangular receptacle constructed of molded plastic with a base portion having upwardly extending members. The members form slots therebetween, and the spliced portions of the first and second sets of wires are physically located within the slots.

The junction assembly can also include an insulative cover having a planar area conforming to the planar area of the rectangular receptacle and mounted to the top thereof. In addition, a second insulative cover is mounted to the top of the main housing and covers the internal spatial area thereof. The housing can also comprise a conduit box mounted at one side of the main housing, with the at least one flexible conduit connected to one side thereof. In addition, an electrical connection device can be connected to the second set of wires and to the outward terminating end of the at least one flexible conduit.

In accordance with another aspect of the invention, the electrical junction assembly further includes a cable support assembly mounted to the main housing within the internal spatial area. The support assembly includes a central rigid portion fixedly secured to the main housing, and a pair of side portions extending outwardly from the central rigid portion. The side portions each have a curved planar configuration, and the conductive wire means are looped around outer lateral surfaces of the side portions. The side portions can be resilient so as to provide automatic retraction of the conductive wire means after external forces causing expansion of the wire means outside of the main housing are released.

The electrical junction assembly can also comprise a second flexible conduit connected to an opposing side portion of the main housing. The conductive wire means are received within the second flexible conduit. In addition, the conductive wire means can comprise a conductive cable multiply looped around the central support assembly. The main housing can comprise upper and lower sections releasably connected together so as to form an enclosed housing. In accordance with another aspect of the invention, the electrical junction assembly can also include at least one electrical receptacle mounted to the main housing. The electrical receptacle can be interconnected with the conductive wire means.

BRIEF DESCRIPTION OF THE SEVERAL VIEWS OF THE DRAWING

The invention will now be described with reference to the drawings in which.

DETAILED DESCRIPTION

Figure 1:
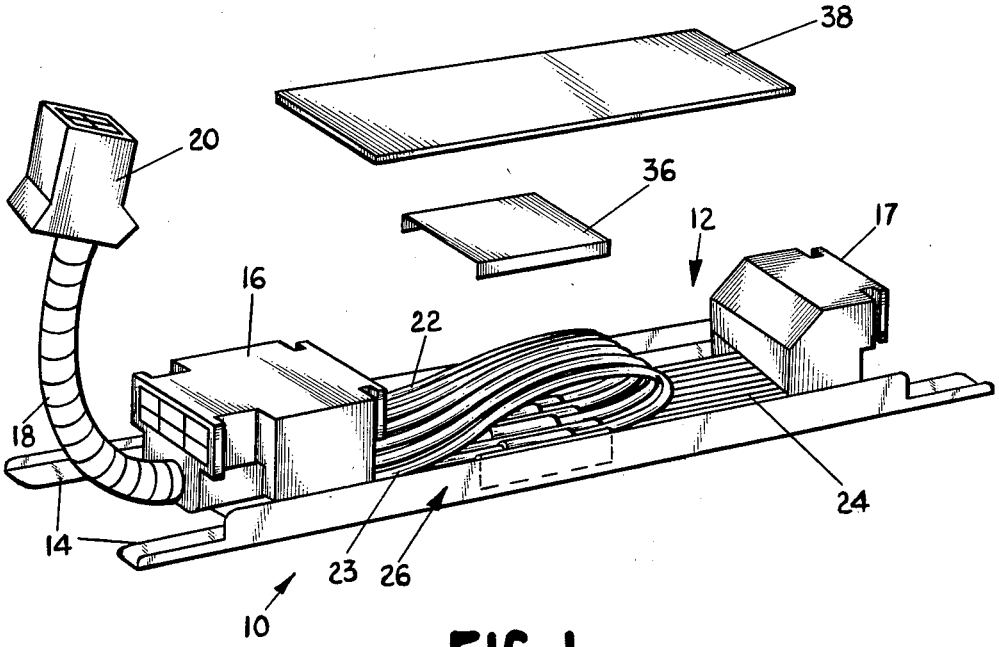
FIG. 1 is a perspective and partially exploded view of one embodiment of an electrical junction assembly with adjustable connectors in accordance with the invention.
Figure 2:
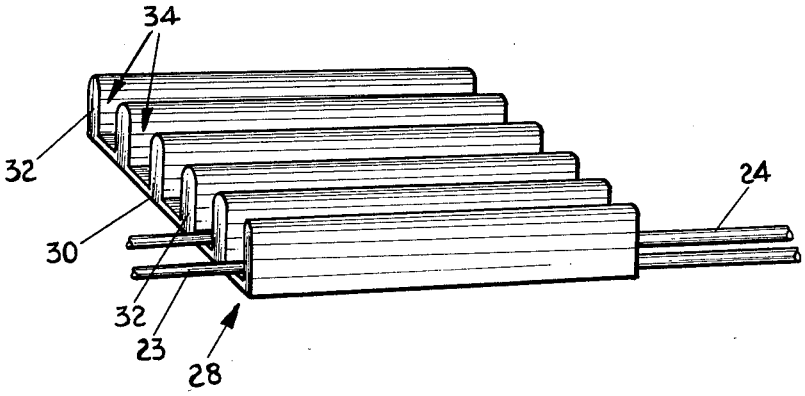
FIG. 2 is an enlarged perspective view of the insulative connector receptacle employed with the electrical junction assembly depicted in FIG. 1.

The principles of the invention are disclosed, by way of example, in an electrical junction assembly 10 as depicted in FIG. 1. Referring to FIGS. 1 and 2, and relevant to other assemblies having adjustable connectors in accordance with the invention and shown in FIGS. 3 and 7, the electrical junction assembly 10 is adapted to provide a convenient means of electrical interconnection between incoming conductors and electrical devices, or between other electrical conductors at various spaced apart locations, in a manner such that the conductive connection can expand or retract as required. The electrical junction assembly 10 also provides a relatively safe structural means for insulating and covering spliced connections between electrical conductors. As subsequently described herein with respect to other embodiments in accordance with the invention, electrical outlets can also be employed with the assemblies.

Referring specifically to FIGS. 1 and 2, the electrical junction assembly 10 comprises a main rectangularly shaped housing 12 permanently enclosed at its lower and side portions, and open at the top. The main housing 12 can be connected to pairs of rails 14 extending outwardly from opposing ends of the main housing 12 as depicted in FIG. 1. The rails 14 can be secured in any suitable manner to an external supporting structure (not shown) so as to maintain the assembly 10 in a stationary position. For example, with the structural configuration of the rails 14 as depicted in FIG. 1, the rails 14 can be employed so as to releasably "slide" into a raceway or similar structure having corresponding slots in which the rails 14 can be positioned. The assembly 10 can also be utilized with other means for rigidly positioning the assembly 10, wherein the means include structures other than the particular configuration of the rails 14 shown in FIG. 1. It will be apparent that the assembly 10 can be employed without any arrangement for rigidly locating the assembly 10 in any particular position.

The electrical junction assembly 10 further comprises a conduit box 16 mounted in a stationary position at one end of the main housing 12 as depicted in FIG. 1. Extending outwardly from one end of the conduit box 16 is a flexible conduit 18. The flexible conduit 18 is conventional in structure and terminates at its opposing end in a connector 20. The connector 20 is also conventional in structure and can, for example, be an assembly for electrically connecting a plug of an electrical device or, alternatively, connecting any other type of interconnection device, such as a corresponding electrical connector. In addition, the connector 20 is adapted to be received and electrically connected to a conduit box identical or comparable to conduit box 16. By means of the conduit 18, the distance between the connector 20 and the conduit box 16 can be adjusted. For example, conduit well known in the art of electrical design can provide a length adjustment of one inch for each four inches of conduit. In accordance with the invention, providing an adjustment relative to the conduit length as decribed above will allow for wiring and frame tolerances in the manufacture and assembly of electrical and associated equipment.

Conductively connected to the connector 20 and received through the flexible conduit 18 are a set of conductive connector wires 22. The connector wires 22 extend inwardly through the upper portion of the conduit box 16 into the main housing 12. As depicted in FIG. 1, the connector wires 22 can be laid in the main housing 12 in a coiled or looped manner so as to provide slack for purposes of expansion and retraction of the distance between connector 20 and conduit box 16 by means of length adjustment of the flexible conduit 18.

Positioned at the opposing end of the main housing 12 of assembly 10 is a conductor connection conduit box 17. The connection box 17 can be substantially equivalent to the conduit box 16 and provides a means for guiding a set of wires 24 into the connecting box 17. Wires 24 can, for example, be a set of energized conductive wires from an external power source or, alternatively, can be interconnected outside of the assembly 10 to other electrical connectors or conductors. In a similar manner, another set of wires 23 extend into main housing 12 from conduit box 16, and are spliced together with wires 24. The wires 23 and 24 terminate at terminals in conduit boxes 16 and 17. These terminals can be connected to additional conductive devices, such as connector 20, to provide requisite electrical paths. It is also apparent that connector box 17 can also have an outwardly connected conduit or similiar wire enclosing structure such as the flexible conduit 18 connected to conduit box 16.

The wires 23 and 24, like the conductive connector wires 22, are laid into the main housing 12. The wires 23 and 24 are brought forward into the main housing 12 into an area designated as splicing area 26 in FIG. 1. Thereat, the conductive wires 23 and 24 can be spliced together and to the conductive connector wires 22 so as to form an electrical connection between the wires 23 and 24, and the external connector 20.

Although the connector wires 22 and wires 23 and 24 are preferably sheathed with a conventional protective insulation, conductive portions of the individual wires may be exposed at the locations where they are spliced together. In addition, splicing connection components may also have exposed conductive surfaces. Accordingly, one problem associated with splicing of wire "sets" is the possibility of electrical arcing between the individual wires of each set, particularly in the area where the wires are spliced together. In addition, the areas where the wires are spliced together can also cause arcing problems with respect to structures near the splicing area, particularly if such structures are in some manner conductive.

To avoid this problem, the electrical junction assembly 10 includes an insulative connector receptacle 28 which is mounted within the main housing 12 in any suitable manner at the splicing area 26. As depicted in the enlarged perspective view in FIG. 2, the connector receptacle 28 comprises a retangular structure having a base portion 30 with members 32 forming a "corrugated" type configuration above and integral to the base portion 30. The corrugated type structure forms a series of slots 34 in which the individual wires of the sets of wires 23, 24 and connector wires 22 can be positioned. With the splicing position of the wires 23, 24 and wires 22 located within the slots 34 of connector receptacle 28, the individual wires are substantially insulated from each other so as to avoid arcing or other degradation of electrical operation. The connector receptacle 28 can preferably be manufactured of a molded plastic or similar insulative material. Although not shown in FIG. 2, the arrangement depicted in FIG. 1 would also include wires 22 extending into receptacle 28 and spliced together with wires 23, 24.

To provide additional insulation, the electrical junction assembly 10 includes an insulative connector receptacle cover 36 conforming to the planar area of the connector receptacle 28 and structured so as to securely fit over the slots 34 and cover the wires 22 and wires 23, 24 at the area where the wires are spliced together. In addition, to provide even still further insulation and to "hide" the wire interconnections for purposes of aesthetics, an insulative housing cover 38 as depicted in FIG. 1 can also be employed. The housing cover 38 has an area conforming to the planar area of of the top opening of main housing 12 and can be secured over the main housing 12 in any suitable manner between the conduit box 16 and connector box 17.

With the connector wires 22 laid within the main housing 12 in a coiled or looped manner, or any alternative manner so as to provide slack, the wires 22 allow for adjustment of the linear distance between external connector 20 and the stationary conduit box 16. In addition, the flexible conduit 18 provides an enclosure for the wires 22 external from the main housing 12 and also provides for adjustment of the linear distance between connector 20 and conduit box 16. It should be emphasized that electrical junction assembly 10 in accordance with the invention allows not only for expansion of the distance between connector 20 and conduit box 16, but also provides for retraction and shortening of this distance as desired after expansion.

Figure 3:
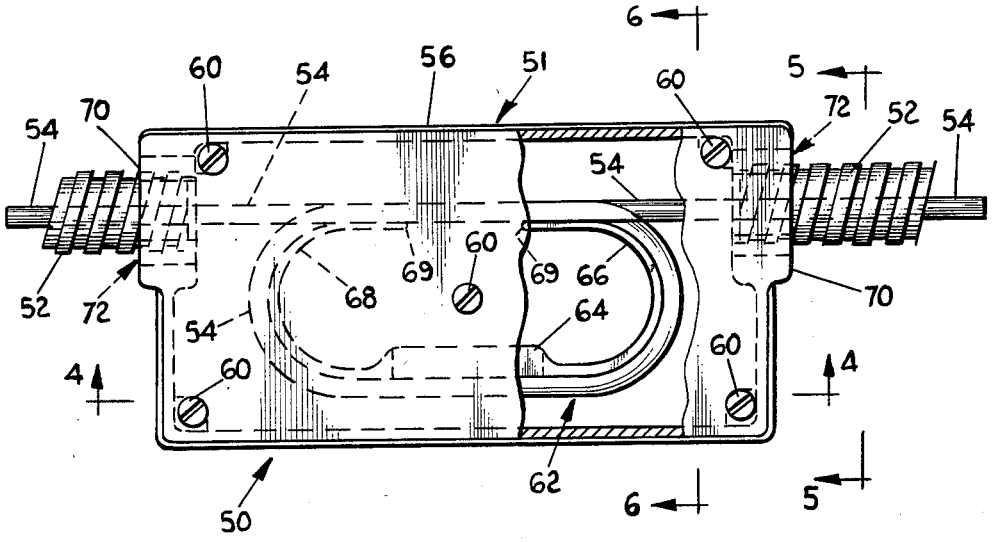
FIG. 3 is a plan view of another embodiment of an electrical junction assembly with adjustable connectors in accordance with the invention, with a portion of the top of the assembly partially broken away.
Figure 4:
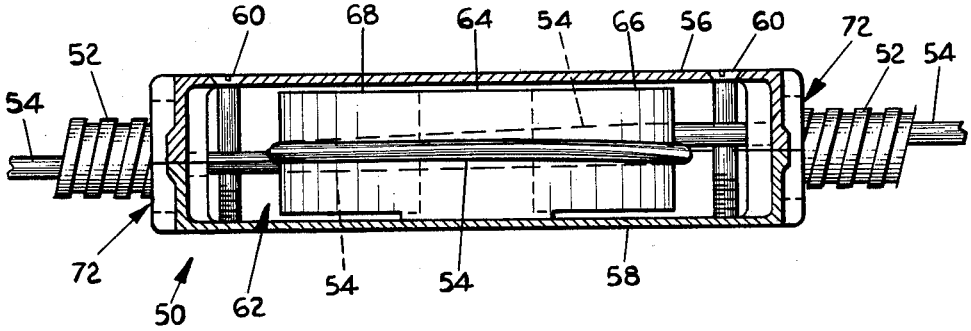
FIG. 4 is a front sectional view of the electrical junction assembly depicted in FIG. 3, taken along section lines 4—4 of FIG. 3.
Figure 5:
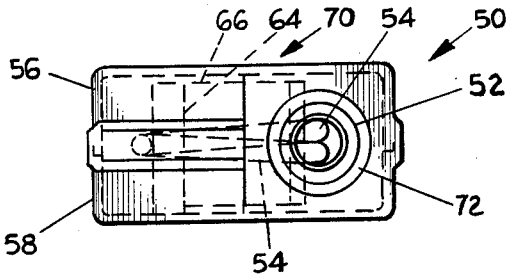
FIG. 5 is an end view of the electrical junction assembly depicted in FIG. 3, taken along lines 5—5 of FIG. 3.

Another embodiment of an assembly for allowing expansion and retraction of electrically interconnecting conductors is depicted in FIGS. 3 through 5 and designated in FIG. 3 as an electrical expansion box 50. The electrical expansion box 50 comprises a rectangularly-shaped center portion 51 having flexible conduits 52 extending outwardly from two opposing sides of the center portion 51 as depicted in FIG. 3. Like the flexible conduit of the assembly 10 previously described with respect to FIGS. 1 and 2, the conduits 52 are flexible in nature and can be adjusted in linear length. For example, commercially available conduit can be employed having an adjustment "rate" of one inch for each four inches of conduit length.

Received through the conduits 52 at each end of the center portion 51 of expansion box 50 is an electrical wire or cable 54. The wire or cable 54 can be a single conductive wire or cable, or alternatively, can comprise separate wires or cables spliced together within the center portion 51 of expansion box 50.

As depicted in FIGS. 4 and 5, the center portion 51 of expansion box 50 comprises a rectangular upper section 56 which can be releasably locked together with a rectangular lower section 58 having a corresponding planar area and shape. The sections 56 and 58 can be locked together by any suitable connecting means such as the countersunk screws 60. As depicted in FIG. 3 with the top of upper section 56 partially broken away, the expansion box 50 includes a central cable support assembly 62 which includes a rectangularly shaped and vertically aligned central rigid portion 64. The central portion 64 is connected to or integral with the internal surface of the bottom of lower section 58.

Extending outwardly from each side of the central rigid portion 64 are vertically aligned side portions 66 and 68 having a planar cross section with a partially curved configuration as depicted in FIG. 3. The side portion 66 and 68 are each curved in opposing directions so as to form an elliptical configuration, and terminate at ends 69 opposing each other as also shown in FIG. 3. The side portions 66 and 68 can be rigid in structure or, alternatively, can be resilient in nature so as to be "spring loaded" and provide a means for automatic retraction of the electrical wire or cable 54 as subsequently described herein.

As depicted in FIGS. 3 and 4, the central portion 51 includes a pair of side portions 70, each located at opposing ends of the expansion box 50. As shown in FIG. 5 with respect to one of the side portions 70, each side portion 70 includes a cylindrical aperture 72 extending horizontally therethrough. The flexible conduit 52 is received within each of the apertures 72 and is rigidly secured to the inner area of each side portion 70 by any suitable connecting means.

As generally shown in FIGS. 3, 4 and 5, the electrical wire or cable 54 is received through the flexible conduits 52 and looped around the cable support assembly 62. With the support side portions 66 and 68 having a rigid structure, extending movement of the wire or cable 54 and corresponding flexible conduit 52 at one end of the expansion box 50 will result in a corresponding retraction of the wire or cable 54 at the opposing end of the expansion box 50. With the side portions 66 and 68 alternatively being resilient so as to provide a spring loading within the central portion 51, the wire or cable 54 can be extended at one end of the expansion box 50 and thereby cause one of the side portions 66 or 68 to be coiled inwardly and tensioned. The resiliency of the side portions 66 and 68 provides a means for allowing extending movement of the wire or cable 54. It is also apparent that with the side portions 66 and 68 being resilient in nature, extension of the electrical wire or cable 54 at both ends of the expansion box 50 can be adhieved. Correspondingly, when extending forces on the wire or cable 54 are released, the resiliency of the side portions 66 and 68 will automatically cause the wire or cable 54 to return to a normal intermediate position.

Figure 7:
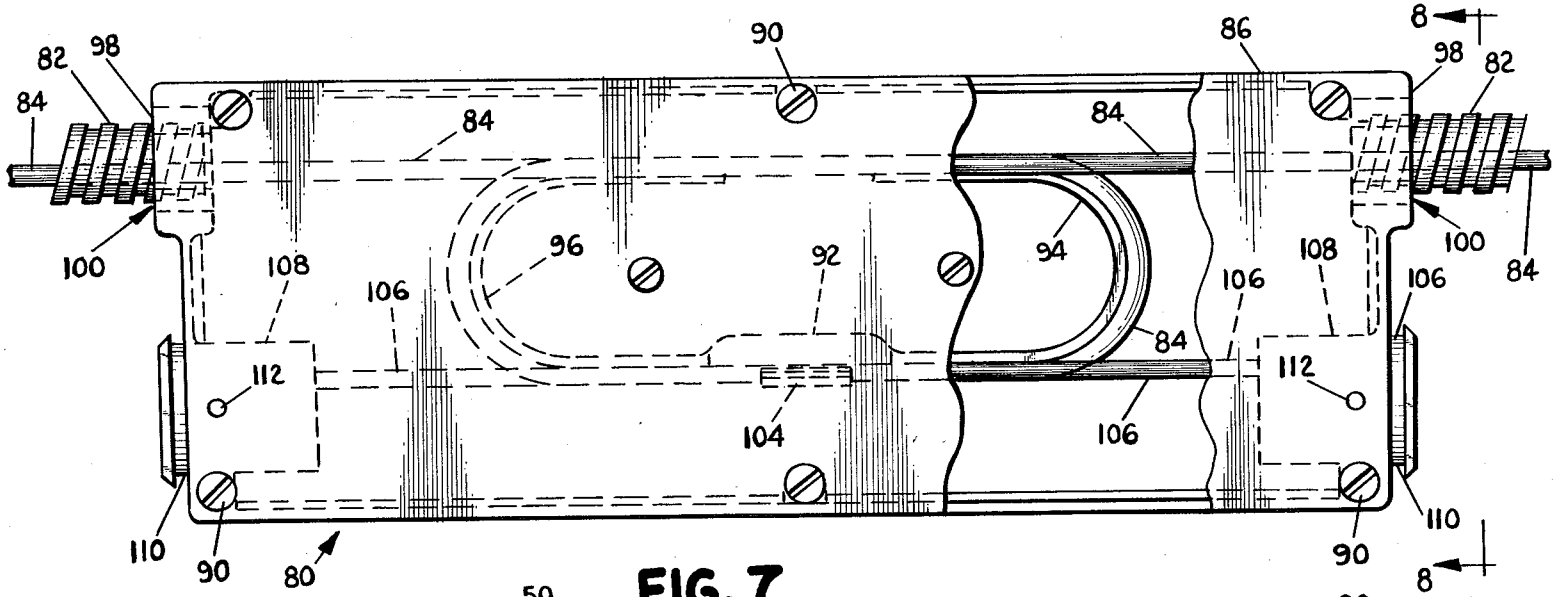
FIG. 7 is a plan view of a modified embodiment of the electrical junction assembly depicted in FIG. 3, with the addition of electrical outlets, the view having a top portion of the assembly partially broken away.
Figure 8:
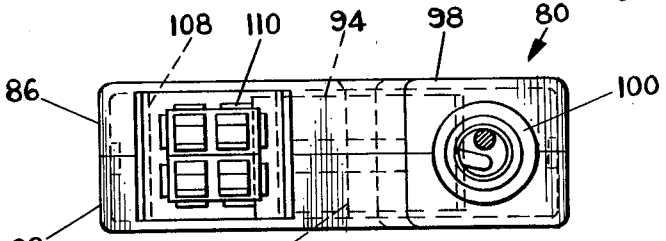
FIG. 8 is an end view of the electrical junction assembly depicted in FIG. 7, taken along lines 8—8 of FIG. 7.
Figure 6:
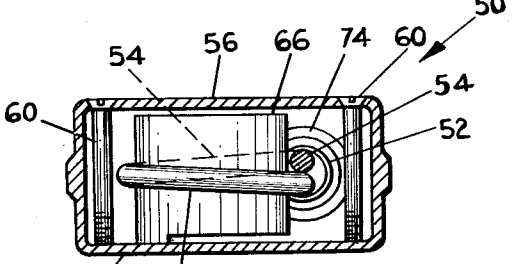
FIG. 6 is an end sectional view of the electrical junction assembly depicted in FIG. 3, taken along lines 6—6 of FIG. 3.

A further alternative embodiment in accordance with the invention and similar to the electrical expansion box 50 is depicted as alternative electrical expansion box 80 in FIGS. 7 and 8. The alternative expansion box 80 comprises flexible conduits 82, electrical wire or cable 84 and upper and lower sections 86 and 88 corresponding to similar components of the expansion box 50 previously described with respect to FIGS. 3 through 5. In addition, the upper and lower sections 86 and 88, respectively, of the alternative expansion box 80 can be interconnected by means of countersunk screws 90. A1so, similar to expansion box 50, the expansion box 80 comprises a central rigid portion 92 having side portions 94 and 96 extending therefrom. Finally, the expansion box 80 also includes a pair of side portions 98 extending from opposing ends of the expansion box 80 and comprising cylindrical apertures 100 through which the flexible conduits 82 are received In accordance with the particular embodiment of the invention as depicted in FIGS. 7 and 8, the electrical expansion box 80 also comprises a splicing area 104 at which the electrical wire or cable 84 can be spliced to additional electrical wires 106 as depicted in FIG. 7. The electrical wires 106 extend laterally from the splicing area 104 as depicted in FIG. 7 and are interconnected to a pair of receptacle outlets 110 at opposing ends of the expansion box 80. The electrical outlets 110 are conventional in nature and can be secured to the expansion box 80 by any suitable connecting means such as the set screws 112. In accordance with the expansion box 80, stationary electrical outlets are provided, in addition to the capability of expansion and retraction of wires or cables 84 through the flexible conduits 82.

It will be apparent to those skilled in the pertinent arts that other embodiments of electrical junction assemblies in accordance with the invention can be designed. That is, the principles of an electrical junction assembly with adjustable connectors are not limited to the specific embodiments described herein. For example, electrical outlets could clearly be included in the assembly 10 or within other similar assemblies in accordance with the invention. Accordingly, it will be apparent to those skilled in the art that modifications and other variations of the above-described illustrative embodiments of the invention may be effected without departing from the spirit and scope of the novel concepts of the invention.

The embodiments of the invention in which an exclusive property or privilege are claimed are defined as follows:

1. An electrical junction assembly adapted for use in interconnecting electrical apparatus with electrical power consumption or supply apparatus, and adjusting the distance between the interconnections, the electrical junction assembly comprising:

a main housing having an internal spatial area, and at least one flexible conduit having one end connected to a side portion of the main housing and extending outwardly therefrom, the flexible conduit being adjustable in axial length between a retracted position and a fully extended position and constructed so as to provide a length adjustment of between one inch and four inches for each eight inches of conduit;

conductive wire means extending inwardly into the main housing at a first location of the housing and extending outwardly from the main housing at a second location of the housing, wherein the conductive wire means is received within the at least one flexible conduit at the second location and a conductive and continuous wire electrical path is maintained between the wire means at the first and second locations;

the conductive wire means comprises a section of wires maintained in a coiled or looped configuration within the spatial area, with the length of the coiled or looped section sufficient to provide slack for full extension and full retraction of the conductive wire section relative to the second location in the form of linear movement of the wire means in correspondence to extension and retraction of the adjustable axial length of the at least one flexible conduit; and an electrical element connected to an opposing end of the conduit and further connected to the conductive wire means so that the wire section will both extend and retract in correspondence to extension and retraction, respectively, of the conduit.

2. An electrical junction assembly in accordance with claim 1 wherein the conductive wire means remains stationary at the first location during extension and retraction of the conductive wire means relative to the second location.

3. An electrical junction assembly in accordance with claim 1 wherein the conductive wire means comprises a first set of wires extending inwardly into the main housing at the first location, and a second set of wires extending outwardly from the main housing and received within the flexible conduit at the second location, and wherein the first and second set of wires are spliced together within the internal spatial area.

4. An electrical junction assembly in accordance with claim 3 and further comprising insulated receptacle means mounted within the main housing for providing insulation between splices of the first and second sets of wires.

5. An electrical junction assembly adapted for use in interconnecting electrical apparatus with electrical power consumption or supply apparatus, the electrical junction assembly comprising:

a main housing having an internal spatial area;

at least one flexible conduit connected to a side portion of the main housing and extending outwardly therefrom, wherein the flexible conduit is adjustable in axial length;

conductive wire means comprising a first set of wires extending inwardly into the main housing at a first location of the housing, and a second set of wires extending outwardly from the main housing and received within the flexible conduit at a second location, and wherein the first and second set of wires are spliced together within the internal spatial area so as to provide a conductive electrical path between the first and second locations;

insulated receptacle means mounted within the main housing for providing insulation between splices of the first and second sets of wires, wherein the insulated receptacle means comprises a receptacle constructed of molded plastic and having a base portion with upwardly-extending members forming slots therebetween, and wherein spliced portions of the first and second sets of wires are physically located within the slots; and the conductive wire means is located within the internal spatial area and coiled or looped thereat so as to provide slack for extension and retraction of the conductive wire means relative to the second location in the form of linear movement of the wire means in correspondence to extension and retraction of the adjustable axial length of the flexible conduit.

6. An electrical junction assembly in accordance with claim 5 wherein the conductive wire means further comprises a third set of wires extending inwardly into the main housing and spliced together with the first and second sets of wires within the slots.

7. An electrical junction assembly in accordance with claim 5 and further comprising:

an insulative cover having a planar area conforming to the planar area of the rectangular receptacle and mounted to the top thereof; and a second insulative cover mounted to the top of the main housing and covering the internal spatial area thereof.

8. An electrical junction assembly adapted for use in interconnecting electrical apparatus with electrical power consumption or supply apparatus, the electrical junction assembly comprising:

a main housing having an internal spatial area;

at least one flexible conduit connected to a side portion of the main housing and extending outwardly therefrom, wherein the flexible conduit is adjustable in axial length;

conductive wire means extending inwardly into the main housing at a first location of the housing and extending outwardly from the main housing at a second location of the housing, wherein the conductive wire means is received within the at least one flexible conduit at the second location and a conductive electrical path is maintained between the wire means at the first and second locations, and with the conductive wire means being located within the internal spatial area and coiled or looped thereat so as to provide slack for extension and retraction of the conductive wire means relative to the second location in the form of linear movement of the wire means in correspondence to extension and retraction of the adjustable axial length of the flexible conduit; and a cable support assembly mounted to the main housing within the internal spatial area, with the support assembly comprising a central rigid portion secured to the main housing and a pair of side portions each extending outwardly from the central portion and having a curved planar configuration, wherein the conductive wire means are coiled or looped around outer lateral surfaces of the side portions.

9. An electrical junction assembly in accordance with claim 8 wherein the side portions of the central support assembly are resilient so as to provide automatic retraction of the conductive wire means after external forces causing expansion of the conductive wire means outside of the main housing are released.

10. An electrical junction assembly in accordance with claim 8 and further comprising a second flexible conduit connected to an opposing side portion of the main housing, wherein the conductive wire means is received with the second flexible conduit.

11. An electrical junction assembly in accordance with claim 8 wherein the conductive wire means comprises a conductive cable multiply looped around the central support assembly.

12. An electrical junction assembly in accordance with claim 8 wherein the main housing comprises upper and lower sections releasably connected together so as to form an enclosed housing.

13. An electrical junction assembly in accordance with claim 8 and further comprising at least one electrical receptacle mounted to the main housing and interconnected with the conductive wire means.

* * * * *